United States Patent [19]

Cocherel

[11] 4,158,897

[45] Jun. 26, 1979

[54] SIPHON

[76] Inventor: Michel Cocherel, 117 Rue Garibaldi, Lyon, France, 69003

[21] Appl. No.: 862,917

[22] Filed: Dec. 21, 1977

[51] Int. Cl.[2] ..... E03C 1/326; F16K 9/00

[52] U.S. Cl. ..... 4/170; 4/187 A; 4/207; 137/247.35

[58] Field of Search ..... 4/166, 167, 170, 187 R, 4/187 A, 197, 206, 207, DIG. 7; 137/247.35, 247.37, 247.39

[56] References Cited

U.S. PATENT DOCUMENTS

| | | | |
|---|---|---|---|
| 1,856,003 | 4/1932 | Thelen | 137/247.35 |
| 1,958,712 | 5/1934 | Nance | 137/247.35 |

FOREIGN PATENT DOCUMENTS

| | | | |
|---|---|---|---|
| 134233 | 7/1933 | Austria | 137/247.35 |
| 570184 | 12/1957 | Italy | 4/206 |
| 177193 | 5/1935 | Switzerland | 137/247.35 |
| 204402 | 10/1923 | United Kingdom | 4/167 |
| 428250 | 5/1935 | United Kingdom | 4/166 |

*Primary Examiner*—Richard R. Stearns
*Attorney, Agent, or Firm*—Fleit & Jacobson

[57] ABSTRACT

In a siphon for lavatory basins and the like, of the kind comprising a main body having an upper inlet opening, a lateral outlet opening and an open lower end closed by a removable socket, the socket is disposed obliquely at an acute angle to the vertical axis of the main body and the inner tube, which is connected to the outlet fitting of the basin, has a lower portion which extends obliquely through the lower end of the main body and into the removable socket, substantially co-axially thereto.

1 Claim, 1 Drawing Figure

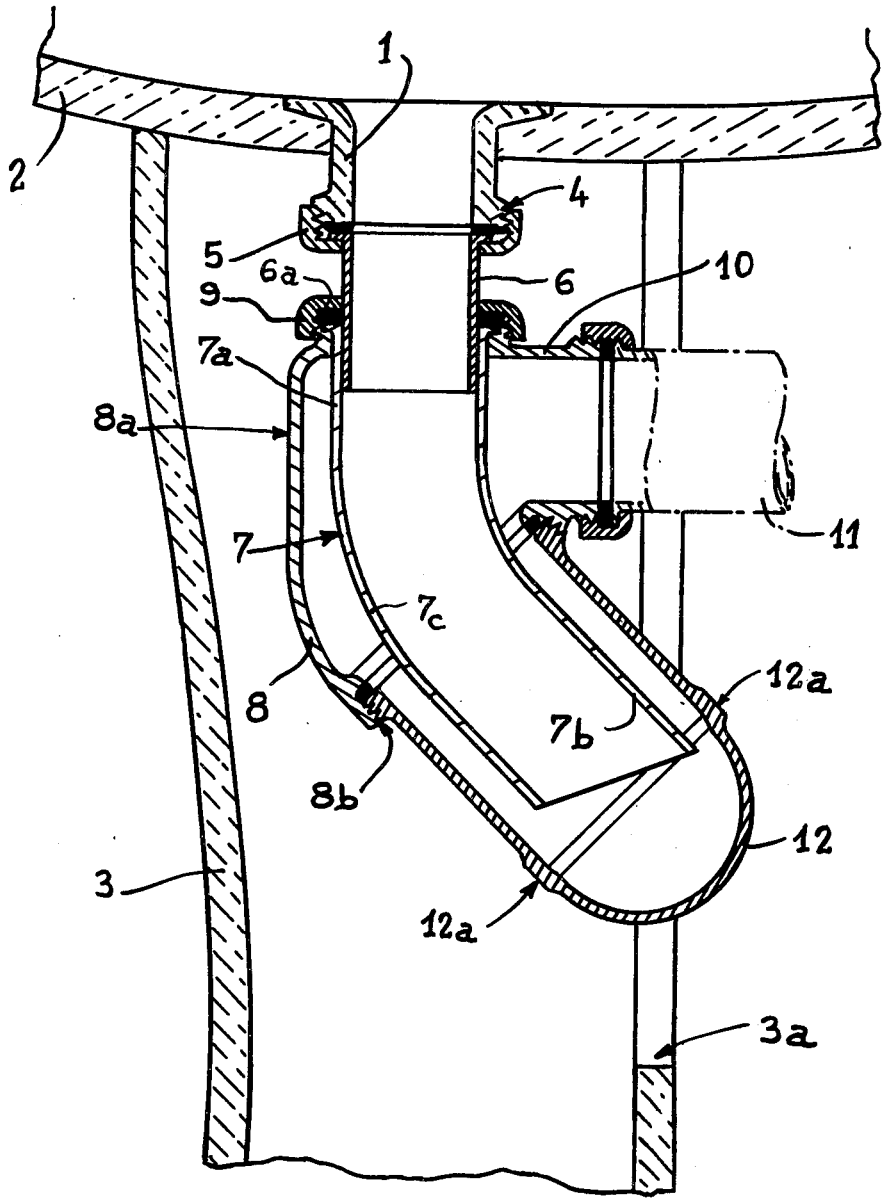
1
2
4
5
6a
6
10
9
7a
8a
11
7
7c
12a
8
7b
8b
12
3
12a
3a

SIPHON

This invention relates to improvements in siphon devices for lavatory basins, bidets and the like, and it more particularly concerns the case of such apparatus supported by a single hollow column or stand.

These apparatus generally include a siphon of the so-called bell type, comprising a removable vertical/-socket-shaped member having a closed lower end and into which the discharge tube extends, the waste water flowing upwardly through the annular space defined by the socket and the tube towards a lateral discharge conduit. The socket is generally screwed onto an annular base which surrounds the discharge tube. In some constructions the tube is replaced by a separating partition. When such a siphon is associated to an apparatus of the kind in question, it is disposed within the hollow stand which is provided for this purpose with a rear lateral aperture through which access may be had to the siphon itself and to the adjacent parts of the discharge system. The disadvantage of such an arrangement is that the removal of the socket is rather difficult, since the rear lateral aperture is of relatively limited dimensions in order not to unduly reduce the mechanical strength of the stand. It is generally almost impossible to use an ordinary spanner for this purpose and therefore special tools are required.

It is the object of the present invention to eliminate this drawback and to provide a siphon device for lavatory basins, bidets and like apparatus supported by a single hollow stand, in which the removable socket may be easily unscrewed and re-screwed.

In accordance with the invention the siphon is disposed obliquely with respect to the vertical direction and the lower end of its removable socket extends through the opening of the stand.

The single FIGURE of the annexed drawing shows in vertical section a siphon device according to the invention associated to a lavatory basin supported by a hollow stand, the basin and the stand being only shown in part.

The siphon illustrated is mounted on the outlet fitting 1 of the basin 2 supported by the hollow stand 3. In the conventional manner this outlet fitting 1 has a screw-threaded lower end 4 which receives an inwardly flanged nut 5 mounted on the outwardly flanged upper end of a short vertical tube section 6 which supports the siphon proper. The latter comprises an inner axial tube 7, a main body 8, a clamping nut 9, a lateral outlet 10 adapted to be connected with a discharge conduit 11, and a removable socket 12. As shown the inner axial tube 7 includes an upper straight vertical portion **7*a*, a lower straight portion 7*b* disposed at an angle of about 45° to the vertical and an intermediate curved portion 7*c*. Its upper end is flanged outwardly to rest on the upper end of the main body 8 on which the nut 9 is screwed. This nut is itself flanged inwardly to compress a ring 6*a* made of a deformable material. Under the effect of compression this material flows inwardly or in other words ring 6*a* contracts on tube section 6 whereon it is strongly retained by friction, thus in turn retaining the axial tube 7 and the main body 8 of the siphon. This main body 8 also comprises a vertical straight portion 8*a* having a curved lower end which terminates in an internally screw-threaded bore 8*b* substantially co-axial to the lower portion 7*b* of tube 7, and which receives the removable socket 12 the closed lower end of which is spaced from the open lower end of tube 7. As shown socket 12 is formed in the vicinity of its lower end with a peripheral polygonal projection 12*a*** by means of which it may be easily rotated with an ordinary spanner.

The tubular stand 3 is formed in the conventional manner with a lateral aperture or window **3*a* and things are preferably so arranged that the lower end of socket 12** projects slightly outwardly of the stand through this opening.

It will be readily understood that the siphon as described operates exactly as the known siphons wherein the lower portion of the co-axial tube and the removable socket are vertical. Waste water flowing downwardly from basin 2 reaches the lower end of socket 12 and it thereafter flows upwardly through the annular space defined by tube 7 and main body 8, while in the absence of water flowing from the basin, socket 12 and the lower portion of body 8 retain a liquid mass which forms a hydraulic seal between the discharge conduit 11 and the outer atmosphere. But while in the known constructions the removable socket is not easily unscrewed and re-srewed, with the invention the lower end of socket 12 is quite easily accessible with an ordinary spanner or like tool.

It has been found of advantage to cut at an angle the lower end of tube 7 as illustrated.

I claim:

1. A lavatory basin assembly comprising:

a basin having a lower outlet fitting defining a substantially vertical axis;

a tubular stand to support said basin, said stand having an upper end which encircles said outlet fitting and being formed with a lateral aperture in the vicinity of its upper end;

a siphon having an inlet connected to said outlet fitting and a lateral outlet adapted to be connected to a discharge conduit through said aperture, said siphon including a lower removable socket disposed along an axis at an acute angle to the vertical, with said socket having a closed lower end which protrudes through said aperture.

* * * * *